United States Patent [19]

Kasai et al.

[11] Patent Number: 4,873,847

[45] Date of Patent: Oct. 17, 1989

[54] APPARATUS FOR DYEING A FABRIC MATERIAL

[75] Inventors: Tomoaki Kasai, Kurobe; Seizo Sekiguchi, Uozu, both of Japan

[73] Assignee: Yoshida Kogyo K. K., Tokyo, Japan

[21] Appl. No.: 261,932

[22] Filed: Oct. 25, 1988

[30] Foreign Application Priority Data

Oct. 27, 1987 [JP] Japan ..... 62-269273

[51] Int. Cl.[4] ..... D06B 3/28

[52] U.S. Cl. ..... 68/178

[58] Field of Search ..... 68/177, 178

[56] References Cited

U.S. PATENT DOCUMENTS

| | | | |
|---|---|---|---|
| 1,778,380 | 10/1930 | Conrad | 68/178 X |
| 3,330,134 | 7/1967 | Carpenter | 68/178 X |
| 3,830,084 | 8/1974 | Caputi | 68/178 |
| 4,142,385 | 3/1979 | Sandberg et al. | 68/178 |
| 4,206,619 | 6/1980 | Fukuroi et al. | 68/20 |
| 4,308,898 | 1/1982 | Yamaguchi et al. | 139/384 B |
| 4,360,937 | 11/1982 | Putnam | 68/178 |

FOREIGN PATENT DOCUMENTS

| | | | |
|---|---|---|---|
| 500233 | 6/1930 | Fed. Rep. of Germany | 68/177 |
| 2137256 | 2/1972 | Fed. Rep. of Germany | 68/177 |
| 2062550 | 6/1971 | France . | |
| 2404693 | 4/1979 | France . | |
| 318056 | 8/1929 | United Kingdom | 68/177 |

*Primary Examiner*—Philip R. Coe

*Attorney, Agent, or Firm*—Hill, Van Santen, Steadman & Simpson

[57] ABSTRACT

An apparatus for dyeing a fabric material comprising a semicircular dye vessel having at opposite ends upwardly directed openings, a first conduit and second conduit connected at one end to the respective openings of the vessel, a dye feed box with a jet nozzle and a deflecting means operatively associated with the jet nozzle. The fabric material is a narrow strip of tape bonded at both ends to form a loop. The deflecting means is rotatable in the first conduit for deflecting the flow of fabric material and dye liquid at an angle of approximately 45° with respect to the vertical axis of the first conduit, the fabric material being oriented to form a succession of loops deposited one upon another and extending substantially radially of the vertical axis.

9 Claims, 3 Drawing Sheets

APPARATUS FOR DYEING A FABRIC MATERIAL

BACKGROUND OF THE INVENTION

1. Field of the Invention

This invention relates to an apparatus for dyeing a fabric material, more particularly to a dyeing apparatus capable of dyeing an elongate loop of fabric material while in recycling flow in contact with a dye liquid.

2. Prior Art

Generally widely known in the art of fabric dyeing are beam dyeing machines, a typical example of which comprises a dye beam having a porous or otherwise permeable cylinder on which a fabric such as in the form of elongate tape is wound to an uniform thickness. There are however limitations to the thickness to which the fabric can be wound on itself in order to ensure adequate and uniform dyeing through the medium of a dye liquid injected forcibly through the wound fabric material. To compensate for such limitations, design considerations would be required to provide a dye beam with a cylinder of larger diameter and increased width, which would literally give rise to equipment size. Conventional dye beams would otherwise require laborious start-up preparations and repeated after-dye take-up and rewind operations.

The prior art beam dyeing would further involve difficulty in achieving take-up of the fabric material in uniform layer throughout the length of the beam and also difficulty in evening out the dye intensity throughout all dimensions of the wound material, i.e. the outer layer, inner layer, opposite ends and center of the material, resulting in speckles or irregularities in the dye finish which would be difficult to eliminate even by rotating the beam or changing the dye flow.

The foregoing difficulties inherent in the beam dyeing machines can be significantly alleviated by a liquid flow type dyeing machine having a dyeing vessel of a relatively large capacity capable of handling a relatively wide fabric material which is allowed to fold on itself while moving through a stream of dye liquid. Whilst this latter machine is satisfactory in treating large width materials, it would present a problem with a narrow strip of material such as a slide fastener tape which is apt to orient out of its normal folded condition under the influence of irregular dye flow and get entangled, twisted or even clogged to plug up the passage of the material.

SUMMARY OF THE INVENTION

It is the primary object of the present invention to provide an apparatus for dyeing a fabric material, e.g. an elongated narrow tape-like strip in particular, the apparatus being simple and compact in construction and capable of dyeing the material uniformly throughout its entire dimensions with increased efficiency and at minimum rate of dye consumption.

According to the present invention, there is provided an apparatus for dyeing a fabric material which comprises a substantially semicircular tubular vessel having at opposite ends thereof upwardly directed openings, a first vertical conduit connected at one end to one of the openings in the vessel, a second vertical conduit connected at one end to the other opening in the vessel, a horizontal connecting conduit extending between and interconnecting the first and second vertical conduits at the respective upper ends thereof, a dye feed box having a jet nozzle and disposed in the first conduit, a flow deflecting means rotatably mounted in the first conduit and having a downwardly slanted portion to deflect the flow of fabric material and dye liquid at a predetermined angle with respect to the central vertical axis of the first conduit, a dye recycle circuit for recycling the flow of dye liquid from the vessel to the first conduit and a fabric recycle circuit for recycling the fabric material through the first conduit, the vessel, the second conduit and the horizontal conduit.

The above and other features of the invention will be apparent from reading the following detailed description with reference to the accompanying drawings in which like reference numerals refer to like or corresponding parts throughout the different views.

DETAILED DESCRIPTION OF THE INVENTION

Figure 1:
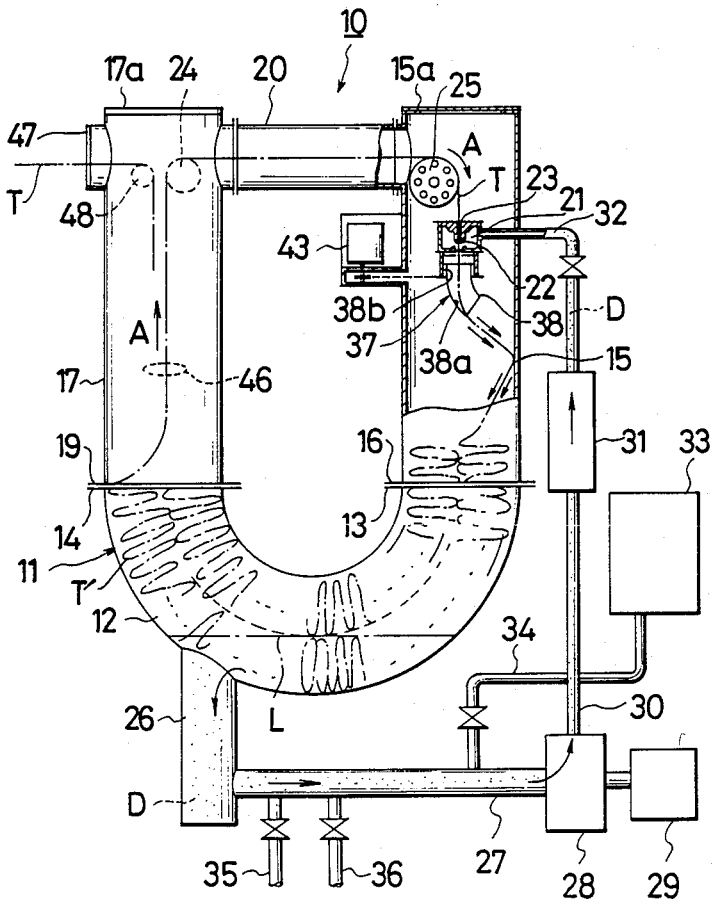
FIG. 1 is an elevational, partly sectional, view of a dyeing apparatus embodying the invention.

Referring now to the drawings and FIG. 1 in particular, there is shown a dyeing apparatus 10 which comprises a generally U-shaped dyeing chamber 11 including a semicircular tubular vessel 12 having upwardly directed openings 13 and 14 at opposite ends. A first vertical conduit 15 is connected at one end to the opening 13 through a connecting flange 16, and a second vertical conduit 17 is similarly connected at one end to the opening 14 through a connecting flange 19. The vessel 12, first and second conduits 15, 17 when thus assembled together present a substantially U-shaped structure as viewed in frontal elevation as in FIG. 1. A horizontal connecting conduit 20 extends between and interconnects the two vertical conduits 15, 17 at their respective upper ends.

A dye feed box 21 with a downwardly directed jet nozzle 22 is mounted within an upper portion of the first conduit 15 and provided centrally with a slit 23 aligned and communicating with the nozzle 22, hence with the interior of the conduit 15.

A fabric material to be dyed is shown for purposes of preferred illustration to be a narrow strip of tape such as a slide fastener tape T carrying a row of coupling elements which is, when paired, termed in the art a slide fastener chain and which is hereinafter called a "tape". The tape T is passed over a guide roll 24 mounted in the second conduit 17 at an upper section thereof merging in flow communication with the horizontal conduit 20, guided through the latter conduit, passed over a feed drive roller 25 located between the conduit 20 and the dye feed box 21 and introduced through the slit 23 into the first conduit 15 and finally into the vessel 12, thus establishing a tape recycle circuit in the U-shaped structure as indicated by the arrow A in FIG. 1.

The upper top ends 15*a*, 17*a* may be left open or tapped with transparent ports for ready inspection of the apparatus interior, or sealed with pressure resistant covers for dye treatment conducted at elevated temperature. Designated at 26 is a dye withdrawal tank connected at one end in flow communication with the bottom of the semicircular tubular vessel 12 and at the other end with a horizontal recycle transfer pipe 27 which is in turn connected to an intake end of a pump 28 actuated by a motor 29. The pump 28 delivers a dye liquid D through a dye recycle circuit in which the dye D is transferred through a vertical transfer pipe 30 up through a heat-exchanger 31 past a horizontal pressure feed line 32 into the dye feed box 21 back into the chamber 11.

Designated at 33 is a dye reserve tank which delivers a fresh supply of dye D, as and when required, to the dyeing system through valved feed pipe 34 connected to the recycle transfer pipe 27 upstream of the pump 28. A valved pipe 35 is adapted to drain use dye, and a valved pipe 36 is adapted to feed water to the system.

A flow deflecting means 37 is provided for baffling or otherwise deflecting the flow of the tape T entrained with the jet stream of dye D, a preferred form of deflecting means 37 comprising a downwardly slanted rotatable tubular baffle 38 having a progressively curved portion 38*a* opening eccentrically into the first conduit 15 and a straight portion 38*b* mounted concentrically in a sleeve 39 rotatably supported on a bearing 40 secured to a bracket 41 which is secured to the dye feed box 21. The tubular baffle 38 is rotatable with the bearing 40 about a central vertical axis X extending longitudinally centrally of the first conduit 15 and is so rotated by a sprocket arrangement comprising a sprocket wheel 42 driven by a motor 43, a sprocket wheel 44 peripherally fitted with the sleeve 39 and a loop chain 45 passed over and between the two wheels 42 and 44.

The tape T moves through the slit 23 in the feed box 21 into the jet nozzle 22 where it merges with the stream of dye D and straight on down until the tape T impinges upon the inner wall of the curved portion 38*a* of the baffle, when it is deflected away from the vertical axis X at an angle $\theta$ in the direction of the arrow. The rotation of the baffle 38 causes the flow of tape T to oscillate or wave and to form a succession of loops T' as the tape T impinges upon and bounces back from the inner wall of the first conduit 15 as shown in FIG. 2.

Figure 2:
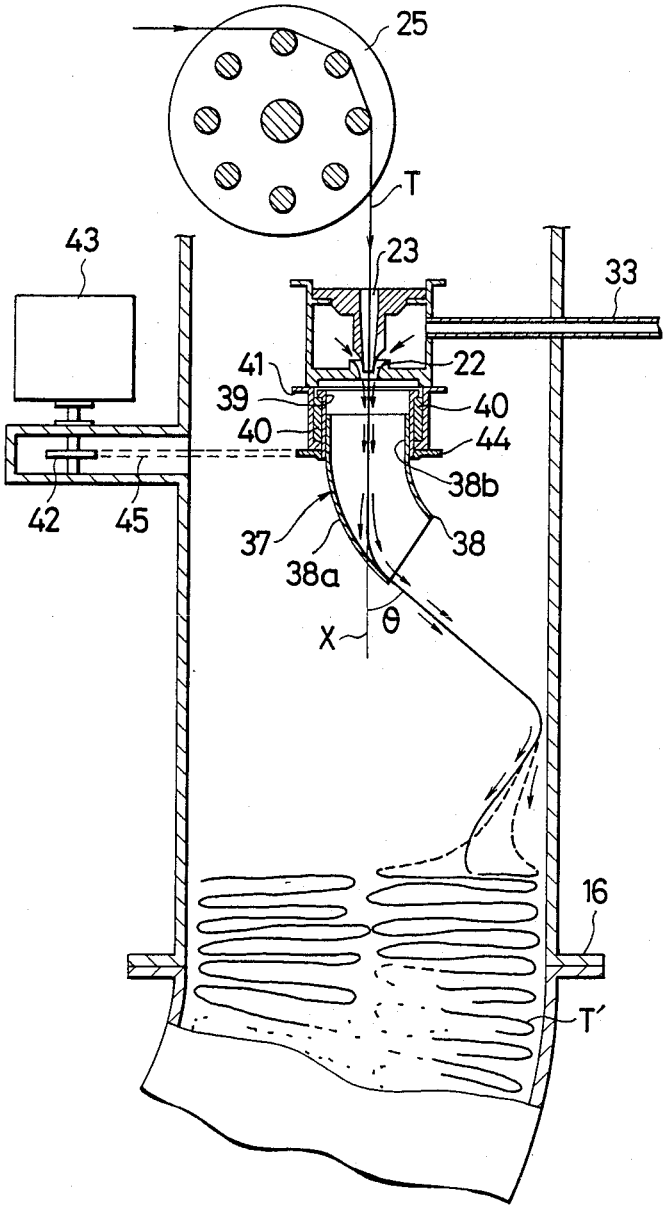
FIG. 2 is an elevational view on enlarged scale of a portion of the apparatus in FIG. 1, which is detailed in cross-section to reveal its interior component parts.
Figure 3:
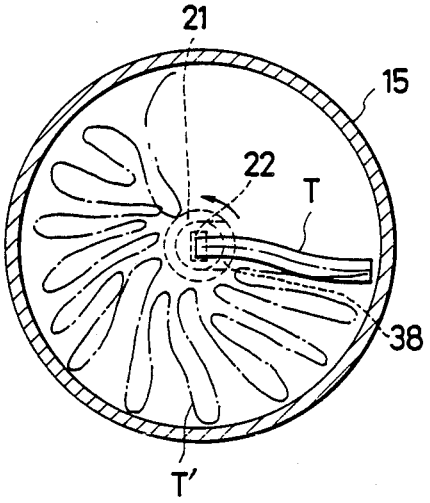
FIG. 3 is a plan view utilized to explain the formation of layered tape strip according to the principles of the invention.

More particularly, the baffle 38 in action produces a pattern of tape motion in which the tape T upon departure from the inner wall of the conduit 15 follows an elongated loop-like path as indicated by dotted line in FIG. 2 and continues to form a succession of such loops T' progressively deposited one upon another substantially in a radial fashion as diagrammatically shown in FIG. 3. The thus radially distributed tape loop T' are accumulated and collected in and to substantially fill the semicircular vessel 12 which serves as a dye bath. The dye liquid D is maintained at a predetermined level L in vessel 12 as shown in FIG. 1 by recycling through the tank 26, transfer pipe 27, pump 28, up pipe 30, heat-exchanger 31 and through feed box 21 and conduit 15 into the vessel 12. While the majority of the tape T is retained long enough to ensure sufficient immersion contact with dye D in the vessel 12, the leading portion of the tape T is picked up in the second conduit 17 and transferred at a predetermined rate of speed through an eye guide 46 past the guide roll 24 and the drive roller 25 back into the chamber 11. Recycling of the tape T is thus repeated as many times as required.

Designated at 47 is an opening for taking in and out the tape T therethrough, and at 48 is a guide roll for withdrawing tape T from the chamber 11.

The tape T is used in the form of an elongated loop according to the invention and is therefore bonded at both ends with an adhesive strip having preferably attached thereto a magnetic film which can be detected by a suitable sensor device located somewhere in the path of travel of the tape T in the chamber 11 so as to meter the number of tape recycles. A specific experimental example of performance of the apparatus above constructed will now be described in connection with dyeing treatment of a slide fastener chain.

The semicircular vessel 12 was a 180° U-bent tube of an inner diameter of 30 cm and a radius of curvature at a central axis of 37.5 cm. The first and second conduits 15 and 17 each were a straight tube of 30 cm in inner diameter and 100 cm in length. The connecting conduit 20 was a tube of 15 cm in inner diameter and 45 cm in length. The dye feed box 21 and the tubular baffle 38 were located at their respective positions in which the tape T had a straight run measuring 45 cm between the top end 15*a* of the first conduit 15 and the point of contact with the inner wall of the baffle 38 from where the tape T was deflected at an angle $\theta$ of 45° with respect to the vertical axis X.

The tape T was a slide fastener chain about 500M long having a pair of support tapes 24 mm wide and 0.5 mm thick and carrying coupled rows of plastics elements 4.2 mm thick along the inner longitudinal edges of the respective tapes. Both ends of the tape T were coupled together by a sewn seam to form a loop. The looped tape T was fed at a speed of 300M/min. with the baffle 38 rotating at 10–30 r.p.m. and folded upon itself at a repetition rate of 30–40 times, until it formed a total of about 50 layers deposited within the vessel 12. About 20–50 liters of dye liquid D corresponding to a bath ratio of 1:4–1:10 was charged to a level L equal to about half of the diameter of the vessel 12 in which the tape T was subjected to dye treatment at 120° C. for one hour. The resulting dyed slide fastener chain was highly satisfactory, being free of speckles, twists or other defects. The invention has been described as applied to fabric dyeing, but may find application for example in the treatment of various used industrial liquids and wastes.

Many changes or modification may be also made as appear obvious to those skilled in the art without departing from the scope of the appended claims.

What is claimed is:

1. An apparatus for dyeing a fabric material which comprises:

(i) a substantially semicircular tubular vessel having at opposite ends thereof upwardly directed openings;

(ii) a first vertical conduit connected at one end to one of the openings in said vessel;

(iii) a second vertical conduit connected at one end to the other opening in said vessel;

(iv) a horizontal connecting conduit extending between and interconnecting said first and second vertical conduits at the respective upper ends thereof;

(v) a dye feed box having a jet nozzle and disposed in said first conduit;

(vi) a flow deflecting means rotatably mounted in said first conduit and having a downwardly slanted portion to deflect the flow of fabric material and dye liquid at a predetermined angle with respect to the central vertical axis of said first conduit;

(vii) a dye recycle circuit for recycling the flow of dye liquid from said vessel to said first conduit; and (viii) a fabric recycle circuit for recycling the fabric material through said first conduit, said vessel, said second conduit and said horizontal conduit.

2. An apparatus according to claim 1 wherein said dye recycle circuit includes a dye withdrawal tank connected to the bottom of said vessel, a transfer piping, a pump, a heat-exchanger and a pressure feed line connected to said feed box.

3. An apparatus according to claim 1 wherein said fabric recycle circuit includes a guide roll adjacent to one end of said horizontal conduit and a feed drive roller interposed between the other end of said horizontal conduit and said feed box.

4. An apparatus according to claim 1 wherein said fabric material is an elongated strip of tape in the form of a loop.

5. An apparatus according to claim 4 wherein said fabric material is a slide fastener chain.

6. An apparatus according to claim 4 wherein said fabric material is bonded at both ends by a magnetically active adhesive strip.

7. An apparatus according to claim 1 wherein said deflecting means is a tubular baffle downwardly curved to deflect the flow of fabric material and dye liquid at an angle of approximately 45° with respect to the central vertical axis of said first conduit, whereby said fabric material is oriented to form a succession of loops deposited one upon another.

8. An apparatus according to claim 1 further including a reserve tank for delivering a fresh supply of dye liquid to the dye recycle circuit.

9. An apparatus according to claim 1 further including a sprocket drive arrangement for rotating said deflecting means.

* * * * *